United States Patent [19]

Smith et al.

[11] 4,022,227

[45] May 10, 1977

[54] METHOD OF CONCEALING PARTIAL BALDNESS

[76] Inventors: Frank J. Smith, 233 Cosmos Drive; Donald J. Smith, 517 Brockway Ave., both of Orlando, Fla. 32807

[22] Filed: Dec. 23, 1975

[21] Appl. No.: 643,681

[52] U.S. Cl. ..... 132/53
[51] Int. Cl.[2] ..... A41G 3/00
[58] Field of Search ..... 132/53, 54, 9, 7, 5; 2/9

[56] References Cited

UNITED STATES PATENTS

| | | | |
|---|---|---|---|
| 3,317,921 | 5/1967 | Zarzour | 2/9 |
| 3,464,424 | 9/1969 | Buzzelli | 132/7 |
| 3,811,453 | 5/1974 | Bretton | 132/53 |

*Primary Examiner*—G.E. McNeill
*Attorney, Agent, or Firm*—John B. Dickman, III

[57] ABSTRACT

A method of styling hair to cover partial baldness using only the hair on a person's head. The hair styling requires dividing a person's hair into three sections and carefully folding one section over another.

5 Claims, 6 Drawing Figures

METHOD OF CONCEALING PARTIAL BALDNESS

BACKGROUND OF THIS INVENTION

For those people who are partially bald and wish to cover the bald area hair transplants, hair weaving and hairpieces are the most commonly used solutions. The cost of covering bald areas by one of these methods can range from a few hundred dollars to thousands of dollars depending on a person's choice and financial means. Some of these commonly used bald area coverings require periodic care, which generally cost money.

Obviously a partially bald person without the financial means can not afford the luxury of such hair coverings. This person, therefore, has few options; he can attempt to use his own hair to cover the bald area, but generally most people do not have the ability to properly plan a hair style that will look good, and most attempts result in brushing the hair in one direction over the bald area, or he can allow his baldness to show.

BRIEF DESCRIPTION OF THIS INVENTION

The method here disclosed uses the remaining hair around the bald area on a person's head. The hair in this area must be extra long to cover the bald area. Generally the hair should be about 3 to 4 inches long.

To use the method of this invention, the hair around the bald area is divided into equal portions, generally three such sections will be used. The sections of hair used by this method generally will be to include equal sections on each side of the head and a third section on the back of the head.

The hair to be used as covering is brushed over the bald area in alternating folds using hair spray to hold the hair in place. The uppermost section can be styled to the person's personal taste.

It is the purpose of this invention to provide a method for covering bald areas using only the hair on a person's head.

Another object of this invention is to provide a method to fold hair in a prearranged design to cover a bald area.

Another object of this invention is to provide a simple method to cover bald areas operable by the user on his own head.

These and other objects will appear more fully from the specification below.

IN THE DRAWINGS

DETAILED DESCRIPTION

Figure 1:
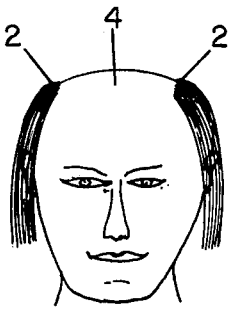
FIG. 1 is an illustration showing a full face view of person who is bald on top and having extra hair length on the sides.
Figure 2:
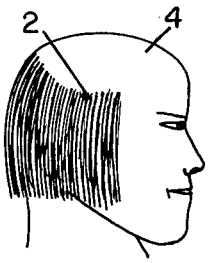
FIG. 2 is an illustration of a side view of the person's head in FIG. 1 showing one side and the back of the head with extra long hair.
Figure 3:
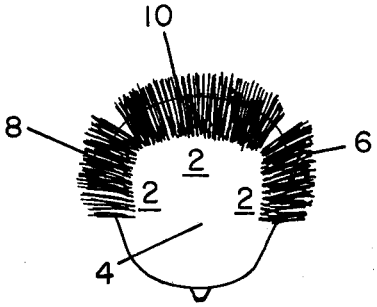
FIG. 3 is an illustration of a top view of the person's head in FIG. 1.
Figure 5:
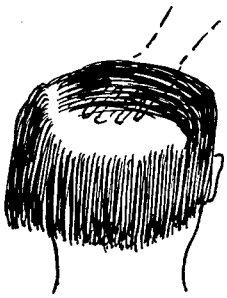
FIG. 5 is an illustration of the back of a person's head with strands from the right side of the head pushed into place.

In the simplest form of the invention my method is directed to a person who is partially bald as the person illustrated in FIGS. 1, 2 and 3 where there is sufficient hair to cover the bald area and by styling give an appearance of having a full head of hair. To begin with the subject's hair must be allowed to grow long enough to cover the bald area, generally about 3 to 4 inches. Of course, the length of the hair will depend on the size of the bald area, for example, a person who is front to back bald, as in the illustrations of FIGS. 1, 2 and 3, will require more length than a person with a bald spot either in front or in back of the head. An addition, the particular hair style to be performed will dictate the required hair length.

Figure 4:
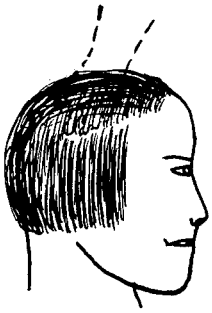
FIG. 4 is an illustration of the persons head in FIG. 2 with the strands of hair from the back of the head pushed into place.

The person's hair line 2, shown in FIGS. 1–3, and bald area 4 suggest that the hair should be divided into three equal sections, sides 6 and 8, and back 10, in starting the method of this invention. A person who has a bald spot in the back of the head could use four equal sections for best results, using my hair styling method. The second step is to take the extra length hair from back area 10 and brushing it forward as in FIG. 4, making sure to cover all of the bald area with hair.

By placing a hand over the hair now covering the bald area and brushing the extra length hair from either of the sides 6 or 8 the hair styling begins to cover the entire bald area. Care should be taken to brush the hair only as it lies over the hand to avoid messing up the hair under the hand. The hair should be arranged and styled at this step since it will soon be covered. To hold the hair in place, hair spray is now applied.

Figure 6:
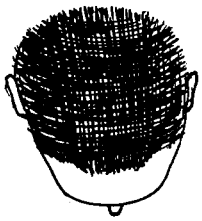
FIG. 6 is an illustration of the person's head in FIG. 3 with a completed hair style.

To complete the hair styling the hair from the side of the head either 6 or 8, whichever has not been used, is brushed over the bald area, making sure to cover the hair now covering the bald area with a hand. This top layer of hair is also styled and coated with hair spray. By lightly sweeping the hair into the desired style as the hair spray dries, an appearance of a full head of hair is given, as in FIG. 6.

To cover a bald spot the same procedure is followed, except that hair from in front of the bald spot can be used, if desired to brush toward the back of the head giving an appearance of a full head of hair.

While the above describes the preferred form of this invention, it is apparent that modifications thereof may occur to those skilled in the art, that will fall within the scope of the following claims.

I claim:

1. A method for styling hair to cover bald areas using only the individual's own hair, comprising separating the hair on the head into several substantially equal sections, taking the hair on one section and placing it over the bald area, then taking the hair on another section and placing it over the first section, and finally taking the hair on the remaining sections and placing it over the other sections whereby the bald area will be completely covered.

2. A method as in claim 1 wherein the hair on a person's head is folded over the bald area beginning with the hair from the back of the head, and then from first one side and then the other.

3. A method as in claim 2 wherein after the hair from the back of the head is folded over the bald area, an object is placed over the hair and hair from a first of the sides is brushed over the object, and after the hair from said first side is folded into place the object is placed over the hair and the hair from the second side is folded over the object.

4. A method as in claim 3, wherein said object is a person's hand the hair spray is applied after the hair from said first side is folded into place and again after said second side being folded into place.

5. A method as in claim 3 wherein the hair from said first side and said second side is given a final styling.

* * * * *